US005836538A

United States Patent [19]

Lencoski et al.

[11] Patent Number: 5,836,538

[45] Date of Patent: Nov. 17, 1998

[54] CUSHIONING CONVERSION SYSTEM WITH STOCK ROLL LIFTER

[75] Inventors: Michael J. Lencoski, Claridon Township; Alvin Wells, Madison, both of Ohio

[73] Assignee: Ranpak Corp., Concord Township, Ohio

[21] Appl. No.: 771,044

[22] Filed: Dec. 20, 1996

Related U.S. Application Data

[63] Continuation of Ser. No. 730,001, Oct. 11, 1996.

[60] Provisional application Nos. 60/005,403, Oct. 13, 1995 and 60/009,294, Dec. 20, 1995.

[51] Int. Cl.[6] ..... B65H 19/12

[52] U.S. Cl. ..... 242/559.1; 414/911; 414/5.46; 242/399.1; 242/559.4

[58] Field of Search ..... 242/559.4, 559.1, 242/399.1, 399.2; 414/911, 546

[56] References Cited

U.S. PATENT DOCUMENTS

| | | | |
|---|---|---|---|
| 839,143 | 12/1906 | Henrikson | 414/546 |
| 1,416,000 | 5/1922 | De Coster | 242/559.1 |
| 1,574,851 | 3/1926 | Seymour | 242/559.4 |
| 1,742,029 | 12/1929 | Fallot | 242/559.4 |
| 2,381,303 | 8/1945 | Mellor | 242/559.1 |
| 2,525,509 | 10/1950 | Pugh | 242/559.4 X |
| 2,543,381 | 2/1951 | Rosenzweig | 414/911 X |
| 2,570,941 | 10/1951 | Grigsby | 242/559.1 |
| 2,666,595 | 1/1954 | Eldh | 242/559.4 |
| 4,750,896 | 6/1988 | Komaransky et al. | 493/357 |
| 5,123,889 | 6/1992 | Armington et al. . | |

*Primary Examiner*—Daniel P. Stodola
*Assistant Examiner*—Gregory J. Strimbu
*Attorney, Agent, or Firm*—Renner, Otto, Boisselle & Sklar, P.L.L.

[57] ABSTRACT

A cushioning conversion system that converts sheet stock material into resilient cushioning product has associated therewith a stock roll support assembly, including a mount, a pedal, and a linkage assembly. The pedal is supported on the mount for pivotal movement about a horizontal axis from a raised position to a depressed position and a pair of laterally spaced apart roll lifter arms cooperate to support therebetween the stock roll for lifting the stock roll from the loading position to the elevated operating position when the pedal is depressed. A stay is provided for holding the roll lifter arms in the elevated operating position to support the stock roll for paying out material therefrom for conversion into the cushioning product.

17 Claims, 7 Drawing Sheets

CUSHIONING CONVERSION SYSTEM WITH STOCK ROLL LIFTER

RELATED APPLICATIONS

This application is a continuation of U.S. application No. 08/730,001, filed Oct. 11, 1996, which claimed priority of U.S. provisional application 60/005,403 filed Oct. 13, 1995 and U.S. provisional application 60/009,294, filed Dec. 20, 1995.

The invention herein described relates generally to a cushioning conversion system for producing resilient cushioning dunnage product from sheet-like stock material supplied in roll form and, more particularly, to an improved device and method for lifting and supporting a roll of stock material for supply of the stock material to a cushioning conversion machine employed in the system.

BACKGROUND OF THE INVENTION

In the process of shipping an item from one location to another, a protective packaging material is typically placed in the shipping case, or box, to fill any voids and/or to cushion the item during the shipping process. Some conventional protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alternative. Paper is biodegradable, recyclable and composed of a renewable resource, making it an environmentally responsible choice for conscientious industries.

While paper in sheet form could possibly be used as a protective packaging material, it is usually preferable to convert the sheets of paper into a pad-like or other dunnage product. This conversion may be accomplished by a cushioning conversion machine, such as that disclosed in U.S. Pat. No. 5,123,889. The therein disclosed cushioning conversion machine converts sheet-like stock material, such as paper in multi-ply form, into a pad-like dunnage product having longitudinally extending pillow-like portions that are connected together along a stitched central portion of the product. The stock material preferably consists of three superimposed webs or layers of biodegradable, recyclable and reusable thirty-pound Kraft paper rolled onto a hollow cylindrical tube. A thirty-inch wide roll of this paper, which is approximately four hundred and fifty feet long, will weigh about 35 pounds (15.9 kg) and will provide cushioning equal to approximately four fifteen cubic inch bags of plastic foam peanuts while at the same time requiring less than one-thirtieth the storage space. The stock material also may be supplied in larger rolls weighing, for example, 105 pounds (47.7 kg).

The multi-ply roll of sheet-like stock material heretofore has been supported at the upstream end of a conversion machine by means of an axle rod that passes through the core of the stock roll with its ends projecting therebeyond for cradled receipt in respective laterally spaced apart mounts of a roll support assembly. The mounts may be provided, for example, directly on the frame of the cushioning conversion machine or on a mobile cart as shown in U.S. Pat. No. 5,123,889.

A stock roll would typically be loaded by positioning a stock roll on the floor or on a stand near the cushioning conversion machine. The axle rod would then be inserted into the center hole in the plug at one end of the roll, through the core tube and then through the center hole in the plug at the opposite end of the roll. The stock roll could then be raised by grasping and lifting the ends of the axle rod that projected from opposite ends of the stock roll. The loading operation is completed by lowering the projecting ends of the axle rod onto the laterally spaced apart mounts that had recesses for cradled receipt and retention of the axle rod.

As shown in U.S. Pat. No. 5,123,889, a cushioning conversion system may include vertical and/or angular adjustments to obtain the desired discharge of the cushioning product at a packaging station. For some applications the machine may be disposed several feet above the floor, which makes loading a stock roll on the machine more difficult because of the greater height to which the stock roll must be lifted. Also, the assembly of the stand, machine and stock roll will have a relatively high center of gravity when a new roll is loaded onto the machine, and the weight of the roll creates substantial moment forces acting on the uprights of the stand. It would be desirable to provide an improvement that would make easier the elevating of a stock roll from the floor level to a height at which the roll could be rotated to dispense the stock material therefrom. It also would be desirable to provide an alternative support for a stock roll that reduces moment loads acting on the uprights of the stand and further to lower the center of gravity of the machine, stand and stock roll assembly.

SUMMARY OF THE INVENTION

The present invention provides a novel stock roll support assembly for a cushioning system that produces a cushioning product from sheet-like stock material supplied as a roll. According to the invention, there is provided in a cushioning conversion system of the aforesaid type a stock roll support assembly for rotatably supporting a roll of sheet-like stock material from which the sheet-like stock material is payed off for conversion by the machine into a cushioning product. The stock roll support assembly includes a mount, a pair of laterally spaced apart roll lifter arms mounted to the mount for movement between (a) a loading position that enables a roll of stock material to be positioned at a loading location on the floor for engagement by the lifter arms and (b) an elevated operating position at which the stock roll engaged by the lifter arms will be raised off of the floor, and a pedal movable between a raised position and a depressed position. The pedal is connected by a linkage assembly to the lifter arms such that when the pedal is depressed (moved from its raised position to its depressed position) the lifter arms move from their loading position to their elevated operating position, thereby raising the stock roll engaged by the lifter arms above the floor to a dispensing position clear of the floor so that the stock roll is free to rotate for paying out stock material for conversion to a cushioning product by the conversion system.

In a preferred embodiment, the linkage assembly includes a pair of laterally spaced apart side linkage members fixedly attached to a shaft that is pivotably mounted to the mount. The lifter arms also are pivotally mounted to the mount and have associated therewith respective crank arms pivotally connected to respective side linkage members at locations radially spaced from the pivot axes of the side linkage members and lifter arms. As is preferred, the pivot connection between the lifter arm cranks and the side linkage members is a sliding pivot (or cam) connection, such as obtained by the crank arms having pins guided in radially elongated slots in the side linkage members. Also, each lifter arm crank and respective lifter arm may be formed as a single piece, as may the pedal with one of the side linkage members.

Further in accordance with a preferred embodiment, the roll lifter arms each have at least one catch for receiving and supporting a stock roll. The catch or catches preferably are in the form of recesses disposed in a row along a top surface of the lifter arm, the recesses being sized to receive a projecting end of a stock roll holder. When the pedal is depressed, the projecting end of the stock roll holder is captured in one of the recesses and thus lifted by the roll lifter arm as it is raised from its loading position to its elevated operating position. The roll lifter arms preferably include lateral stops laterally outwardly adjacent the recesses to prevent lateral shifting of the stock roll holder relative to the roll lifter arms. It will also be seen that in a preferred embodiment the recesses in each lifter arm open substantially circumferentially relative to the rotation axis of the lifter arm and are spaced apart by radially extending cam surfaces which aid in urging a projecting end of a stock roll holder into an adjacent recess.

Also in a preferred embodiment, a stay is provided for fixing the roll lifter arms in the elevated operating position thereof. It will also be seen that in a preferred embodiment the stay is a spring-loaded latch pin that fixes the pedal in the depressed position with respect to the mount.

The invention also provides a method for loading a stock roll in a cushioning conversion system using the stock roll support assembly. The method comprises the steps of positioning a stock roll at a delivery or loading location when the roll lifter arms are in their loading position. The pedal is then depressed to its depressed position thereby moving the roll lifter arms to their elevated operating positions, the roll lifter arms cooperatively engaging and supporting therebetween the stock roll for lifting the stock roll from the loading location to an elevated operating position permitting rotation of the stock roll.

Preferably, a stock roll holder is assembled with respect to the stock roll with opposite ends of the stock roll holder projecting axially beyond respective distal ends of the stock roll, and the stock roll is rolled along a surface until the ends of the stock roll holder come into close proximity with or contact the top surfaces of the roll lifter arms. When the roll lifter arm is moved from its loading position to its elevated operating position, the top surfaces thereof act as guides, directing the ends of the roll holder into an adjacent recess on the roll lifter arms, the recesses on the roll lifter arms engaging and holding the ends of the stock roll holder as the lifter arms are raised. Raising the roll lifter arms preferably is effected by depressing the pedal at a point spaced radially from its fulcrum thereby to obtain a mechanical advantage and thus make it easier to lift heavy rolls.

The foregoing and other features of the invention are hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 7:
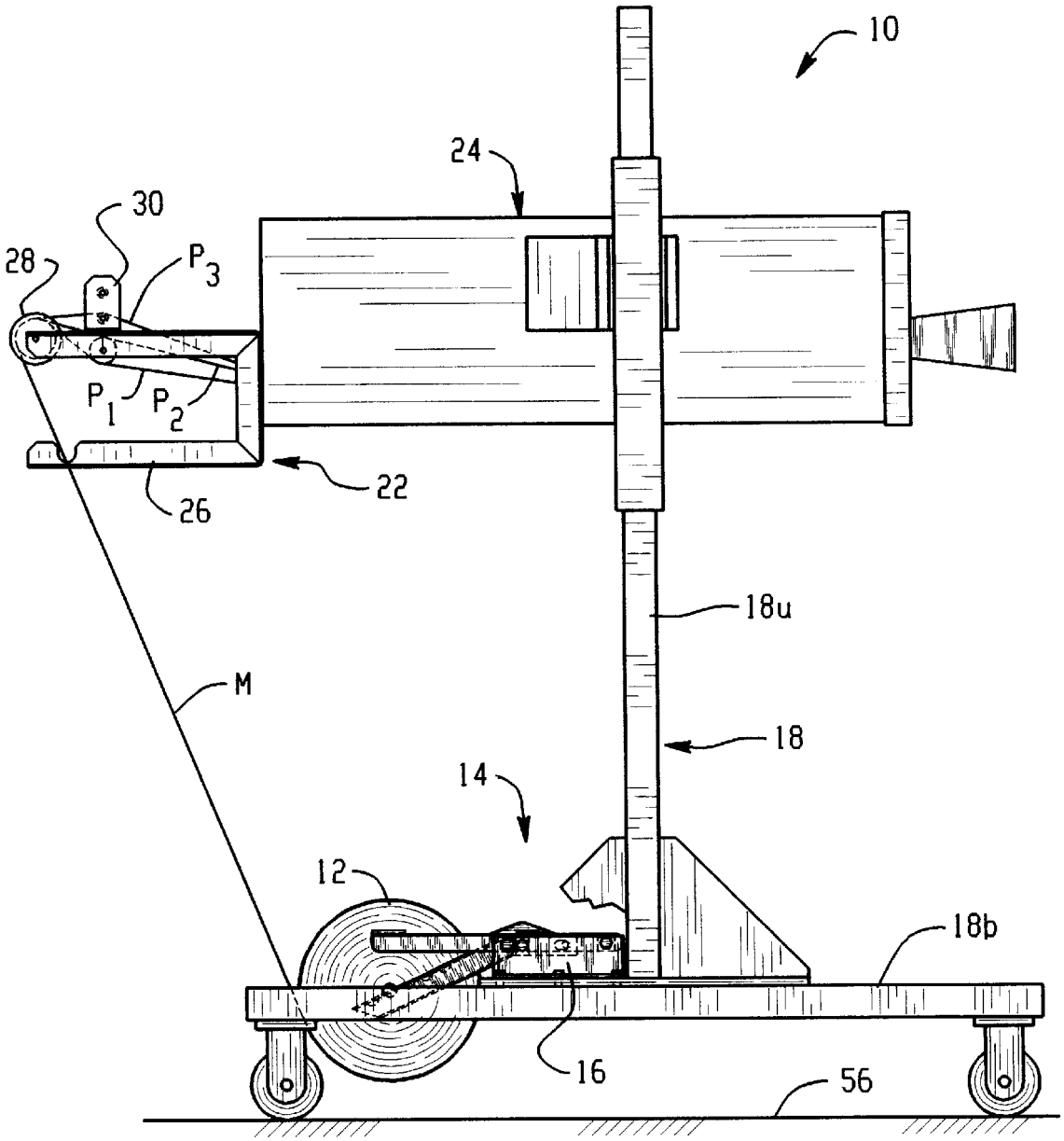

Referring now in detail to the drawings and initially to FIG. 7, there is illustrated a cushioning conversion system 10 and, more particularly, a cushioning conversion system 10 that converts sheet-like stock material M payed off from a stock roll 12 into a resilient cushioning product. The stock roll 12 is rotatably supported by a stock roll support assembly 14 which is hereinafter described in greater detail. However, it is here noted that the stock roll support assembly 14 in the cushioning conversion system 10 is in part formed by a mount composed of mounting members 16 that are secured to or form a part of a frame 18. As will be appreciated the mounting members 16 function as a mount for the assembly.

Figure 8:
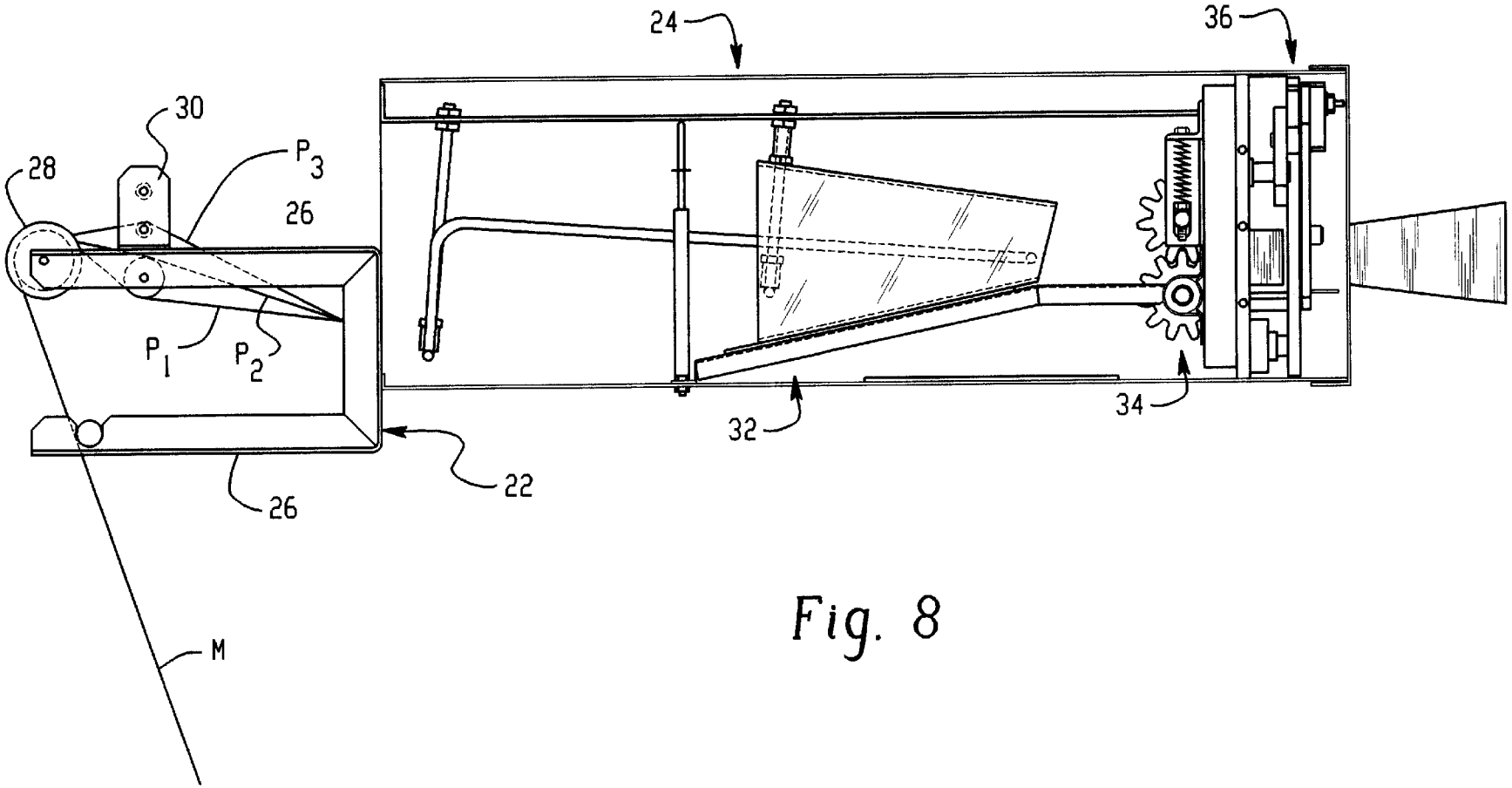
FIG. 8 is a side view of an exemplary preferred conversion machine useful in the system, the side panel of the machine nearest the viewer being removed to illustrate internal components of the machine.

As seen in FIGS. 7 and 8, a pair of laterally spaced apart U-shape brackets 22 are secured to the rear or upstream end of a conversion assembly 24. The upstream projecting legs 26 of brackets 22 have journalled therebetween the ends thereof a constant entry roller 28 that provides a non-varying point of entry for the sheet-like stock material M from the stock roll 12. The legs 26 also support therebetween a separating mechanism 30 which receives the sheet-like stock material M from the constant entry roller 28 and separates multiple plies $P_1$ through $P_3$ from one another prior to passage to a forming assembly in the conversion machine 24. For further details concerning the constant entry roller and separating mechanism, reference may be had to U.S. Pat. No. 4,750,896.

The illustrated preferred cushioning conversion assembly 24 shown in FIG. 8 is part of the illustrate an exemplary preferred cushioning conversion machine, other cushioning conversion machines also being useful in practicing the invention. The preferred illustrated cushioning conversion machine includes a forming assembly 32, a feed/connecting assembly 34 and a cutting assembly 36. For a detailed disclosure of the cushioning conversion machine shown in FIG. 8, reference may be had to U.S. Pat. No. 5,123,889, the disclosure of which is hereby herein incorporated by reference.

Details of the stock roll assembly 14 will now be described primarily with reference to FIGS. 1 through 4. As shown, the stock roll support assembly 14 includes a mount here represented, as above indicated, by a pair of brackets 16 secured to the base of the frame 18. The assembly 14 further comprises a pair of laterally spaced apart roll lifter arms 38 mounted to the brackets 16 by respective shoulder bolts 39 for pivotal movement, a linkage assembly 40 which includes a side linkage member 42 and a side linkage member 43 both fixedly attached to a shaft 44 for rotation therewith. The side linkage member 43 has an integral lever arm extension 45 terminating at an accessible pedal 46 disposed at one side of the stock roll assembly 14. As will be appreciated, a pedal may be similarly provided at the other side of the stock roll assembly 14, with either pedal then being usable to effect a loading operation in the below described manner. Also, the pedal 46 and associated lever arm need not be formed as a single piece with the side linkage member 43, although this provides advantages such as minimizing the number of parts, reducing assembly time, reducing cost, etc.

Figure 4:
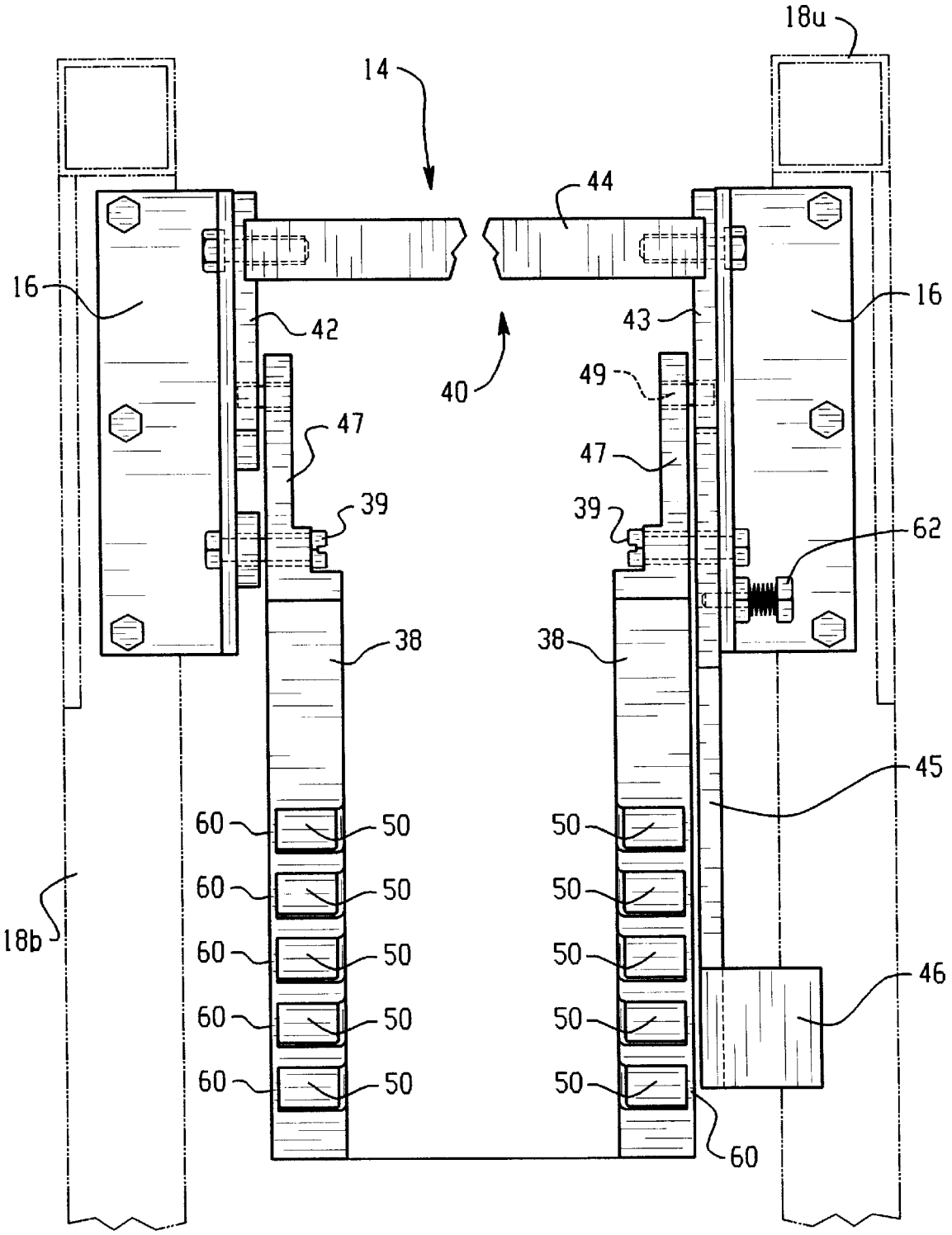
FIG. 4 is a top view of the roll support assembly, looking from the line 4—4 of FIG. 3.

The shaft 44 is pivotably mounted to the brackets 16. As shown in FIG. 4, the shaft and side linkage members form a U-shape linkage with the shaft 44 forming the base of the U and the side linkage members forming the legs of the U. In relation to the axis of the shaft 44, the mouth of the U opens radially outwardly to accommodate large diameter stock rolls that may be loaded into the cushioning conversion system 10. It can also be seen that the roll lifter arms 38 are parallel and laterally spaced apart to receive therebetween a stock roll 12.

The lifter arms 38 have associated therewith respective crank arms 47 which extend radially from the pivot axis of the lifter arms opposite the lifter arms 38. As shown, the lifter arm 38 and crank arm 47 at each side of the stock roll support assembly 14 preferably are formed as a single piece, with attendant advantages such as those indicated above in connection with the pedal 46. The crank arms 47 are pivotally connected to respective side linkage members at locations radially spaced from the pivot axes of the side linkage members and lifter arms. As is preferred, the pivot connection between the arm cranks and the side linkage members is a sliding pivot (or cam) connection, such as obtained by the crank arms having pins 49 guided in radially elongated slots 51 in the side linkage members.

Figure 1:
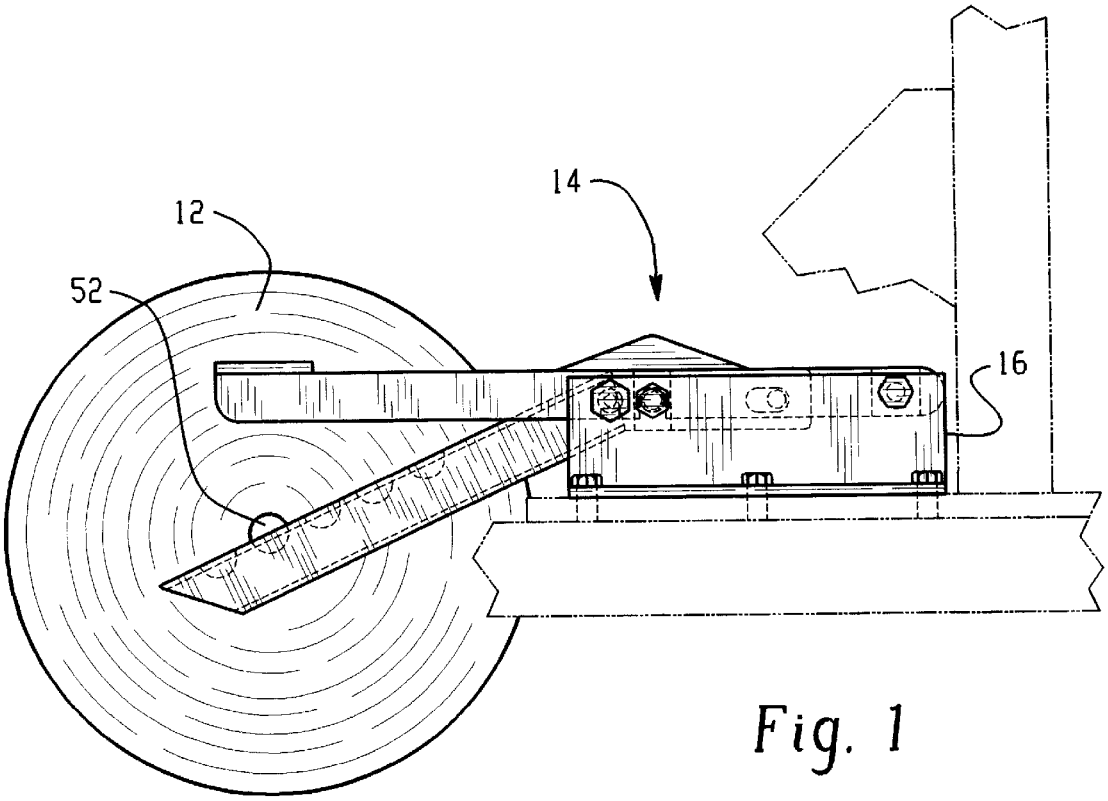
FIG. 1 is a side elevational view of a roll support assembly according to the invention, showing roll lifter arms of such assembly supporting a stock roll in an elevated operating position.

Each of the roll lifter arms 38 is provided with at least one catch for engaging a stock roll directly or through a stock roll holder. In the illustrated embodiment, the catch is in the form of an upwardly opening recess and preferably there are a plurality of such recesses 50 for receiving and supporting a stock roll 12 or, more particularly, the projecting ends of a stock roll holder 52. The recesses 50 on the roll lifter arms 38 are adapted to engage the distal ends of a stock roll holder 52 for lifting the stock roll 12 to a position spaced above the floor 56 when the lifter arms 38 are moved from their loading position (FIGS. 2 and 6) to their elevated operating position (FIGS. 1 and 7). The stock roll holder may be, for example, an axle rod or a holder like that described in U.S. patent application No. 08/267,960. The plurality of recesses 50 enable a wide range of stock roll diameters to be accommodated.

In the illustrated embodiment, the frame 18 includes square-shaped tubular posts or uprights 18*u* that are laterally spaced apart and extend upwardly from laterally spaced apart frame elements or beams 18*b*. Although not shown, the frame elements 18*u* and 18*b* are joined together by appropriately located cross frame members. If desired, the frame may be equipped with casters 54 for rolling of the system from one location to another. The casters (or other wheels) are positioned to provide 4-point stable support of the cushioning conversion system 10 on the floor 56. For further details of the frame 18 and the manner in which the machine 24 may be adjustably mounted thereto, reference may had to U.S. Pat. No. 5,123,889.

As will be appreciated by those skilled in the art, the illustrated arrangement facilitates retrofitting existing cushioning conversion systems, such as the type of system disclosed in U.S. Pat. No. 5,123,889. However, it should be understood that the elements of the roll support assembly 14 may be supported in other ways, either as part of the frame 18 or provided as a separate component, such as a cart, positionable adjacent the system.

In the illustrated embodiment, the roll lifter arms 38 of the roll support assembly 14 are long arms extending substantially radially from and substantially perpendicular to the pivot axis thereof. The roll lifter arms 38 are laterally spaced apart and generally parallel to each other.

In operation, the roll lifter arms 38 cooperate to support therebetween the stock roll 12. Each roll lifter arm 38 is supported for pivotal movement, although other arrangements could be employed. These linkage connections between the roll lifter arms and side linkage members permit the roll lifter arms 38 to respond to the action of the pedal 46 such that they rotate upwardly about the shoulder bolt pivots 39 and thereby raise the stock roll 12 from the loading position (FIGS. 2 and 6) to the elevated operating position (FIGS. 1 and 7).

Figure 2:
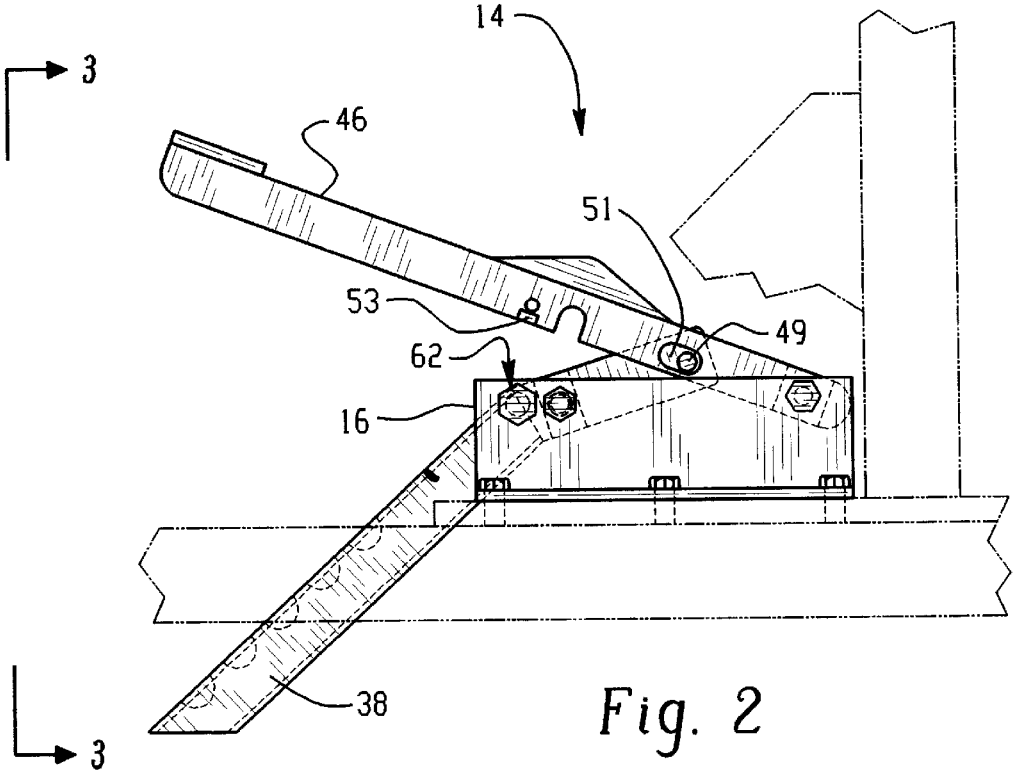
FIG. 2 is a side elevational view of the roll support assembly similar to FIG. 1, but showing the roll lifter arms in a loading position.
Figure 3:
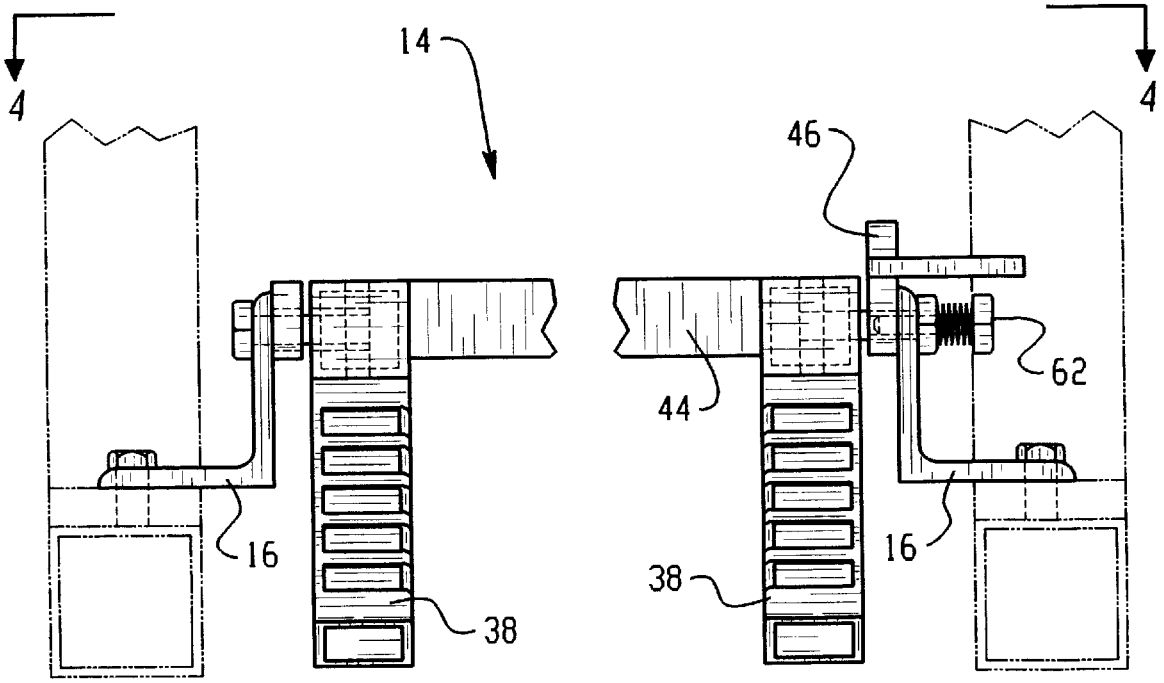
FIG. 3 is an end view of the roll support assembly.

As best shown in FIGS. 2 through 4, the recesses 50 preferably open circumferentially relative to the pivot axis of the lifter arms 38. The bottom of the recess preferably conforms generally to the shape of the holder end to be engaged therein. For example, for a round shaft, the bottom of the recess preferably is arcuate with a radius approximately equal or slightly greater than the radius of the ends of the axle rod or other stock roll holder. The top surface portions of the roll lifter arms 38 intermediate the recesses 50 function as guides for engaging and guiding the ends of the axle rod or other stock roll holder 52 into an adjacent recess 50 as the roll lifter arms 38 are raised from the loading position (FIGS. 2 and 6) to the elevated operating position (FIGS. 1 and 7).

The roll lifter arms 38 preferably are provided with lateral stops 60. The lateral stops 60 are located at laterally outer sides of the roll lifter arms 38 to limit lateral (axial) shifting movement of the roll holder 52 when received in the recesses 50. In the illustrated embodiment, the lateral stops 60 are an integral part of the roll lifter arms 38 themselves. The recesses 50 are formed such that the outer end of each recess 50 is closed for closely accommodating the portions of the stock roll holder 52 that project laterally outwardly beyond the stock roll 12. At the laterally outer sides of the roll lifter arms 38, the lateral stops 60 are formed by the enclosed outer end of the recesses 50.

Various means could be employed to raise the roll lifter arms 38 between the loading position (FIG. 6) and the elevated operating position (FIG. 7) including, for example, powered means such as an electric motor. The motor may be mounted to the frame 18 and connected to the pedal (lever end) 46 by a suitable drive mechanism such as a screw drive. As another example, a hydraulic or pneumatic piston-cylinder assembly may be connected between the pedal 46 and the frame 18 such that extension and retraction of the piston-cylinder assembly raises and lowers the roll lifter arms 38. Manually operated devices such as toggle mechanisms, ratchet and pawl mechanisms, etc. may also be used.

However, for economic, weight, and other reasons, the roll lifter arms 38 preferably are manually swung up and down by the pedal 46. To this end, the pedal 46 is extended radially from the pivot axis of the shaft 44 and connected to a roll lifter arm 38 so as to provide in effect a lever having a mechanical advantage of about two, three or more. A mechanical advantage of two in effect reduces the effective weight of the stock roll 12 by 50%. Whereas a mechanical advantage of three reduces the effective weight of the stock roll by 67%. Moreover, depressing the pedal 46 to effect raising and lowering the stock roll 12 is an easier motion than that which otherwise would be involved to lift the stock roll 12 without the aid of the roll support assembly 14 or with a hand operated lever mechanism.

When the pedal 46 has been moved to its depressed position as shown in FIGS. 1 and 7, the roll lifter arms 38 have moved to the elevated operating position and support thereon a stock roll 12 in the manner illustrated, the weight of the stock roll 12 will exert a counterclockwise moment force on the roll lifter arms 38 as viewed in FIG. 1. To hold the roll lifter arms 38 in the operating position, there is provided a stay that may be conveniently mounted to the side of the roll support assembly 14. As shown in FIGS. 2 and 4, the pedal extension 45 has a hole for receiving a spring-loaded latch pin 62 mounted to one of the mounting brackets 16. To release the pedal, the pin 62 may be pulled out against the spring biasing force (to the right in FIG. 4) to permit lowering of the roll lifter arms 38. Conversely, the pin 62 may be engaged by moving the roll lifter arms 38 upwardly to align the pin with the hole in the extension 44 and then releasing the pin 62 such that the pin 62 is pushed into the hole in the pedal extension. If desired, the outer side of the pedal extension 45 may be provided with a ramp surface 53 leading to the hole (detent opening) therein, so as to engage and progressively cam the latch pin 62 laterally outwardly until the hole moves into lateral alignment with the pin 62 during raising of the lifter arms 38, at which point the pin 62 will spring into the hole and lock the lifter arms 38 in their elevated operating position.

The latch pin 62 or other releasable latching device may be provided at other locations if desired. More generally, any suitable means may be employed as a stay to hold the roll lifter arms 38 in the operating position. The roll support assembly 14 may also be counterbalanced by suitable means such as counterweights, springs, etc. which operate to counterbalance the weight of the stock roll 12 to any desired degree, thereby to lessen the lift weight of the pedal 46 for loading a stock roll 12.

Figure 5:
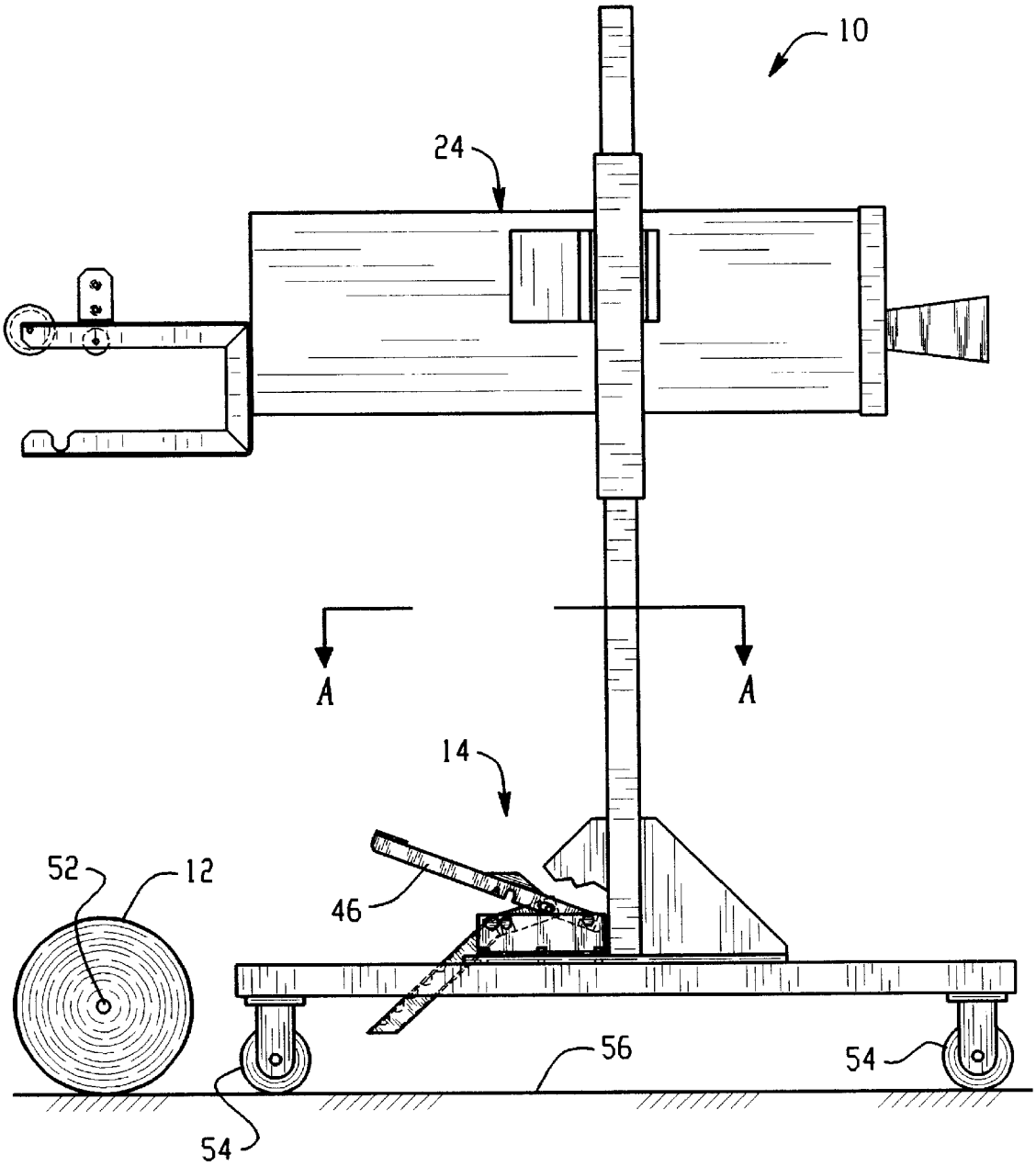
FIGS. 5 through 7 are side elevational views of a cushioning conversion system embodying a stock roll support assembly in accordance with the present invention, sequentially illustrating the manner in which a stock roll is loaded into the system in accordance with the method of the invention.
Figure 6:
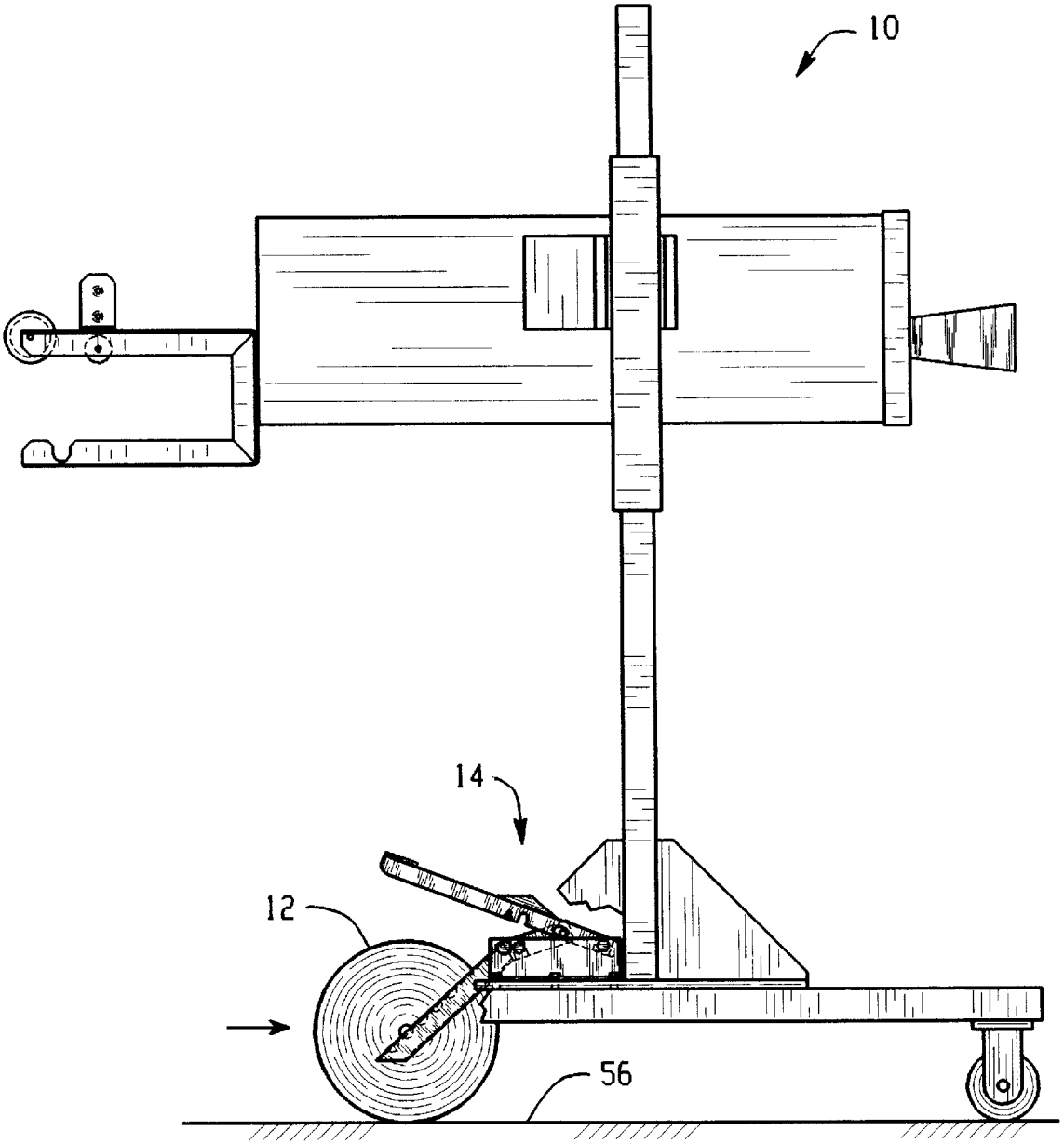

Referring now to FIGS. 5 through 7, a stock roll 12 is loaded into the cushioning conversion system 10 in the following manner according to the method of the present invention. Initially, the stock roll 12 is positioned on the floor 56 behind the frame 18 as shown in FIG. 5 and generally aligned with the roll support assembly 14. If not done earlier, a stock roll holder 52 may be assembled with respect to the stock roll 12 with the distal ends thereof projecting axially beyond the ends of the stock roll 12. For example, an axle rod may be inserted through the hollow core of the stock roll 12 in the well known manner.

With the roll lifter arms 38 in the loading position as illustrated in FIG. 5, the stock roll 12 may be rolled forwardly to a delivery or loading location shown in FIG. 6. The stock roll 12 may be moved forward until the roll holder 52 ends contact the top surfaces on the roll lifter arms 38.

At this point, the pedal 46 may be depressed to raise the roll lifter arms 38 upwardly. As the roll lifter arms 38 move upwardly, the top surfaces of the roll lifter arms 38 guide the projecting ends of the roll holder 52 along the top surfaces of the roll lifter arms 38 and into adjacent recesses 50. The roll holder 52 also will be constrained from lateral shifting movement by the lateral stops 60 on the roll lifter arms 38. Further raising of the roll lifter arms 38 to the position shown in FIG. 7 will effect lifting of the stock roll 12 to an operating position above the floor 56 thereby to allow free turning movement of the stock roll 12 on the roll holder 52. The roll lifter arms 38 are swung upwardly sufficiently to engage the spring-loaded pin 62 in the hole in the pedal extension 45 for retention of the roll support assembly 14 in the position shown in FIG. 7. When thus positioned, the stock roll 12 will be held in a position from which the stock material M may be payed off the stock roll 12 for passage into the conversion machine 24 and conversion into a cushioning product. If desired, the roll lifter arms 38, pedal and linkage may be dimensioned and arranged such that when the roll lifter arms 38 are swung upwardly and brought to rest at the elevated operating position, the radially outermost end of the pedal 46 is in such a position that allows the projecting end of the roll holder 52 to move therebeneath as the stock roll 12 is lifted, and permits the pedal 46 to be depressed sufficiently such that depressing the pedal 46 brings the roll lifter arms 38 to the elevated operating position without interference from the axially outwardly extending ends of the roll holder 52. Also, the lower position of the roll lifter arms 38 may be such that the free ends thereof will be supported on the floor for receiving a stock roll.

As will be appreciated by those skilled in the art, the method of the invention may be practiced with stock roll holders 52 other than an axle rod. Other types of holders may be employed in accordance with the present invention, for use in conjunction with the recesses 50 or other types of catches provided on the roll lifter arms 38.

While the roll lifter arms 38 in the illustrated embodiment employ recesses 50 for receiving the projecting ends of the axle rod or other holder 52, the roll lifter arms 38 may be provided with other means for accomplishing the same function of releasably engaging and holding the stock roll 12 therebetween. For example, the roll lifter arms 38 may each be equipped with axially movable spindles that may be telescoped into the ends of the stock roll core. Accordingly, the stock roll 12 may be positioned such that the roll lifter arms 38 when lowered align the spindles with the core of the stock roll 12 at which point they can be shifted axially inwardly and into the ends of the stock roll core. Once engaged, the roll lifter arms 38 can be raised to lift the stock roll 12 to its operating position for paying out the stock material M.

Although the invention has been shown and described with respect to a preferred embodiment, it will be apparent that equivalent alterations and modifications will occur to others skilled in the art upon the reading and understanding of this specification. The present invention includes all such equivalent alterations and modifications.

What is claimed is:

1. A cushioning conversion system for producing a cushioning product from sheet stock material supplied as a stock roll, comprising a conversion assembly which converts the sheet stock material into the cushioning product and a stock roil support assembly;

the stock roil support assembly comprising a mount, a pair of laterally spaced apart roll lifter arms mounted to said mount for movement between a loading position and an elevated operating position, a pedal connected to a linkage assembly for movement between a raised position and a depressed position;

said linkage assembly connected to said roll lifter arms and said pedal such that movement of said pedal between said raised position and said depressed position effects movement of the roll lifter arms between said loading position and said elevated operating position;

each of said roll lifter arms including a plurality of recesses linearly disposed along a top surface of the roll lifter arm and upwardly opening when the roll lifter arm is in the loading position, each of the recesses in one of the roll lifter arms being aligned with a respective one of the recesses in the other of the roll lifter arms thereby providing aligned pairs of recesses for receiving ends of a roll holder used to rotatably support the stock roll whereby rolls of different diameters may each be accommodated by a respective pair of said aligned pairs of recesses.

2. A cushioning conversion system as set forth in claim 1, wherein said linkage assembly includes a pair of laterally spaced apart side linkage members fixedly attached to a shaft, said shaft mounted to said mount for pivotal movement and said roll lifter arms connected to said side linkage members respectively.

3. A cushioning conversion system as set forth in claim 2, wherein said pedal is connected to an extension of one of the side linkage members for pivotal movement about a horizontal axis from the raised position to the depressed position.

4. A cushioning conversion system as set forth in claim 3, wherein said pedal is an integral part of said extension of said one of the side linkage members to which the pedal is connected.

5. A cushioning conversion system as set forth in claim 1, wherein each of said roll lifter arms includes lateral stops adjacent said recesses for preventing lateral shifting of the roll holder relative to said roll lifter arm.

6. A cushioning conversion system as set forth in claim 1, wherein said stock roll support assembly includes a stay for releasably engaging one of said roll lifter arms and maintaining the roll lifter arms in said elevated operating position.

7. A cushioning conversion system as set forth in claim 6, wherein said stay includes a spring-loaded pin that fixes the roll lifter arms in said elevated operating position.

8. A cushioning conversion system as set forth in claim 1, wherein said stock roll support assembly further includes a separating mechanism for separating multiple plies of the sheet stock material payed off of said stock roll.

9. In a cushioning conversion system for producing a cushioning product from sheet stock material supplied as a stock roll, a cushioning conversion machine and a frame for holding said machine at an elevated position, said frame comprising a vertical support to which said machine is mounted and a base extending in opposite directions from said vertical support for supporting said frame on a horizontal surface, said base including spaced apart roll lifter arms for supporting therebetween distal ends of a stock roll holder for raising the stock roll from a loading position to an elevated operating positions;

each of said roll lifter arms including a plurality of recesses linearly disposed along atop surface of the roll lifter arm and upwardly opening when the roll lifter arm is in the loading position, each of the recesses in one of the of the roll lifter arms being aligned with a respective one of the recesses in the other of the roll lifter arms thereby providing aligned pairs of recesses receiving the distal ends of the stock holder that is used to rotatably support the stock roll whereby rolls of different diameters may each be accommodated by a respective pair of said aligned pairs of recesses.

10. A cushioning conversion system as set forth in claim 9, wherein said cushioning conversion machine is adjustably mounted to said frame for dispensing the cushioning product at a desired packing station.

11. A cushioning conversion system as set forth in claim 9, wherein said cushioning conversion machine is mounted to said frame such that the cushioning conversion machine may be adjusted vertically for delivering the cushioning product to a packing station at a convenient height.

12. A cushioning conversion system as set forth in claim 11, further including a separating mechanism for separating multiple plies of the sheet stock material payed off of the stock roll.

13. A method for loading a stock roll onto a cushioning conversion system, the system using a stock roll support assembly having a pair of roll lifter arms, a pedal for causing a linkage assembly to act on said roll lifter arms such that when the pedal is moved from a raised position to a depressed position the roll lifter arms move from a loading position to an elevated operating position, each of said roll lifter arms including a plurality of recesses linearly disposed along a top surface of the roll lifter arm and upwardly opening when the roll lifter arm is in the loading position, each of the recesses in one of the roll lifter arms being aligned with a respective one of the recesses in the other of the roll lifter arms thereby providing aligned pair of recesses for receiving opposite ends of a stock roll holder used to rotatably support the stock roll whereby rolls of different diameters may each be accommodated by a respective pair of said aligned pairs of recesses, said method comprising the steps of assembling the stock roll support assembly with respect to said stock roll with the opposite ends of the stock roll holder projecting axially beyond respective ends of said stock roll; positioning the stock roll at a delivery location when said roll lifter arms are in said loading position, positioning the opposite ends of the stock roll holder within one of the respective pair of said aligned pair of recesses, depressing the pedal such that said roll lifter arms raise said stock roll, said roll lifter arms cooperating to support therebetween said stock roll and lifting said stock roll from the loading position to the elevated operating position.

14. A method as set forth in claim 13, wherein said positioning steps further include the step of rolling the stock roll along a surface to said delivery location.

15. A method as set forth in claim 13, wherein said positioning steps further include the step of rolling said stock roll along a surface until each of the opposite ends of said stock roll holder engage an respective one of the top surfaces of said roll lifter arms.

16. A method as set forth in claim 13, wherein said positioning steps further include the step of guiding said stock roll holder along the top surfaces of said roll lifter arms until aligned pair of recesses engage said stock roll holder and lifting the opposite ends of the stock roll holder as said roll lifter arms raise from said loading position to said elevated operating position.

17. A method as set forth in claim 13, wherein the stock roll is composed of a material that is biodegradable, recyclable and renewable.

* * * * *

UNITED STATES PATENT AND TRADEMARK OFFICE
Certificate

Patent No. 5,836,538 Patented: November 17, 1998

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Michael J. Lencoski, Claridon Township, OH; Alvin Wells, Madison, OH; and James A. Simmons, Painesville Township, OH.

Signed and Sealed this Thirtieth Day of May, 2000.

DANIEL P. STODOLA
*Supervisory Patent Examiner*
Art Unit 3634